US011684170B2

(12) United States Patent
Robinson

(10) Patent No.: US 11,684,170 B2
(45) Date of Patent: Jun. 27, 2023

(54) PROTECTIVE TRAY WITH AN INTEGRATED DUST COVER FOR A SOFA

(71) Applicant: Ashley Furniture Industries, LLC, Arcadia, WI (US)

(72) Inventor: Jeremy Robinson, Pontotoc, MS (US)

(73) Assignee: ASHLEY FURNITURE INDUSTRIES, LLC, Arcadia, WI (US)

( * ) Notice: Subject to any disclaimer, the term of this patent is extended or adjusted under 35 U.S.C. 154(b) by 451 days.

(21) Appl. No.: 16/777,489

(22) Filed: Jan. 30, 2020

(65) Prior Publication Data

US 2020/0245779 A1 Aug. 6, 2020

Related U.S. Application Data

(60) Provisional application No. 62/799,625, filed on Jan. 31, 2019.

(51) Int. Cl.

| | |
|---|---|
| ***A47C 31/10*** | (2006.01) |
| ***B65D 5/28*** | (2006.01) |
| ***B65B 5/02*** | (2006.01) |

(52) U.S. Cl.

CPC ..... *A47C 31/10* (2013.01); *B65D 5/28* (2013.01); *B65B 5/026* (2013.01); *B65D 2585/647* (2013.01)

(58) Field of Classification Search

CPC ..... B65D 5/28; B65D 2585/647; B65D 2585/648; B65D 5/0095; B65D 19/44; B65D 2519/00815; B65D 85/64; A47C 31/10; A47C 31/11; A47C 5/005

USPC ..... 229/190, 122.3, 87.02; 206/326, 521, 206/599; 150/158; 108/55.3

See application file for complete search history.

(56) References Cited

U.S. PATENT DOCUMENTS

| | | | | | |
|---|---|---|---|---|---|
| 1,188,825 | A | * | 6/1916 | Potter | 229/110 |
| 1,741,369 | A | | 12/1929 | Kondolf | |
| 2,170,224 | A | | 8/1939 | Tarr | |
| 2,306,987 | A | * | 12/1942 | Yount | A47C 31/11 206/494 |
| 2,313,362 | A | | 3/1943 | Rous | |
| 2,633,982 | A | * | 4/1953 | Addison | B65D 19/44 108/55.3 |

(Continued)

FOREIGN PATENT DOCUMENTS

| | | |
|---|---|---|
| CN | 203497441 U | 3/2014 |
| JP | 2694526 B2 | 12/1997 |

OTHER PUBLICATIONS

International Search Report for Application No. PCT/US2020/015896 dated Jul. 23, 2020.

Fig 1 admitted prior art (pre Jan. 1, 2019) 1 pg.

*Primary Examiner* — Christopher R Demeree

(74) *Attorney, Agent, or Firm* — Christensen, Fonder, Dardi & Herbert PLLC

(57) ABSTRACT

An upholstered sofa sits in a protective tray with an integrated dust cover. The protective tray attached to a wood frame of the sofa around a frame opening at a dust cover portion of the protective tray. The tray having a separable juncture between an edge portion of the dust cover portion and the portions of the protective tray surrounding the dust cover portion, whereby portions of the tray surrounding the dust cover portion may be removed at a retail sales location or a user's home. The protective tray with the integrated dust cover is semi-rigid and may be attached robotically at the manufacturer's facility.

11 Claims, 14 Drawing Sheets

(56) References Cited

U.S. PATENT DOCUMENTS 2,675,955 A * 4/1954 Gibbons ..... A47C 31/11 229/125.21
2,766,816 A 10/1956 Koenigsberg
2,864,438 A 12/1958 Levine
3,891,086 A 6/1975 Isaacs
3,978,982 A * 9/1976 Duncan ..... A47C 31/11 206/326
4,030,600 A 6/1977 Heaps
4,114,755 A * 9/1978 Aust ..... B65D 5/0095 229/110
4,126,222 A * 11/1978 Aust ..... B65D 5/0095 206/326
4,549,711 A 10/1985 Giltnane
4,619,362 A * 10/1986 Crowe ..... B65D 5/0095 229/110
4,762,226 A 8/1988 Gatton
4,871,061 A * 10/1989 Schneider ..... B65D 5/0095 206/326
5,143,133 A * 9/1992 Speckman ..... A47C 31/10 428/536
5,407,078 A * 4/1995 Strauser ..... B65D 71/0092 206/326
5,445,435 A * 8/1995 Sheckles ..... B60N 2/3097 297/452.12
6,006,905 A * 12/1999 Campbell, Jr. ..... B65D 81/03 206/778
6,149,240 A 11/2000 Pietrzak
6,409,267 B1 6/2002 Pietrzak
6,796,614 B1 9/2004 Paul
10,640,286 B1 * 5/2020 Lycourt ..... B65B 5/04
2003/0226783 A1 12/2003 Jackson et al.
2005/0017553 A1 1/2005 Duncan et al.
2005/0066446 A1 3/2005 Gladney
2012/0118774 A1 5/2012 Loth
2016/0038335 A1 2/2016 Park et al.
2017/0129766 A1 5/2017 Fukuzawa et al.
2018/0289157 A1 10/2018 Marshall et al.
2018/0289158 A1 10/2018 Marshall et al.

* cited by examiner

PROTECTIVE TRAY WITH AN INTEGRATED DUST COVER FOR A SOFA

CROSS-REFERENCE TO RELATED APPLICATION

This application claims the benefit of U.S. Provisional Application No. 62/799,625, filed Jan. 31, 2019, the entire contents of which is incorporated by reference herein.

FIELD OF THE DISCLOSURE

This invention relates to furniture. More specifically, this invention relates to upholstered furniture and their methods of manufacture and shipping.

BACKGROUND

A typical piece of upholstered furniture, such as a chair or sofa, includes a seat deck assembly supported by a frame. Manufacture of upholstered furniture generally begins with assembling the frame. Wood or wooden products are often used to construct a frame in the general shape of the furniture, which may include arm rests, the supporting portions for the seat deck assembly, and a back rest. After the frame is complete and the seat deck assembly installed, upholstery fabrics are typically secured around the bottom edge of the frame through fixed fastening means. This leaves the bottom open, exposing unsightly items such as springs or coils, allowing dust to collect within the frame, and allowing loose remnants to fall from the furniture to the floor.

Conventionally, the bottom opening is covered with a fabric dust cover, such as cambric, to create a more aesthetically pleasing appearance. The fabric dust cover is secured to the bottom of the frame, covering the rough edges of the upholstery fabric, through fixed fastening means, typically staples. A fabric dust cover is too flimsy for automation, requiring manual installation. Tools required for applying the fasteners to the frame are relatively expensive, may be dangerous to operate, and require extensive training before operating. Securing the fabric may also require an exorbitant number of fasteners, sometimes hundreds per piece of furniture, driving up the cost to manufacture each piece of furniture. Securing the fabric may also be very time consuming as a fabric dust cover must be perfectly cut and aligned to achieve an aesthetically pleasing look on a finished product. The quality of the dust cover install can be highly dependent upon the skill and training of the installer.

Once a piece of upholstered furniture is complete, it must be shipped from the manufacturing site. The fabric dust cover and bottom periphery of the furniture are particularly susceptible to damage during transport. Therefore, at additional expense, manufacturers often place the furniture on cardboard trays to help prevent the dust cover and bottom furniture edges from getting ripped, dented, dinged, other being otherwise damaged during transport. Once the furniture arrives at its final location, these cardboard trays are discarded as waste. Minimizing labor and parts costs, making the process safer, and making the process less dependent upon the training and skill of the installer, would result in better manufacturing efficiencies, more consistent quality sofas, better value for the consumer, less waste, and would be well received by the industry.

SUMMARY

A packaged upholstered sofa in accordance with embodiments of this disclosure comprises an upholstered sofa with a wood frame in a protective tray with an integrated dust cover for protecting the lower periphery of the sofa during transport and storage, and for providing a permanent dust cover for the bottom of the sofa. The protective tray with the integrated dust cover has a semi-rigid dust cover portion sized for an open bottom of the sofa, and a tray periphery with four sidewalls portions. The tray periphery supporting and retaining the semi rigid dust cover and being separable from the dust cover when ready for the show room or customer use.

In embodiments, the sofa generally has a rectangular footprint and forms a box frame with a left panel, a right panel, a front panel, and a back panel. Each of the left, right, front, and back panels have a lowermost edge and an outside face. A bottom side has a rectangular peripheral frame defining an open bottom, the rectangular frame having a downwardly facing peripheral frame surface.

In embodiments, a dust cover portion of a semi-rigid tray with an integrated dust cover is fixedly attached to the undermost edge of left, right, front, and back panels, such that the peripheral edge of the upholstery cover is captured within the protective tray with an integrated dust cover. In embodiments, the integrated dust cover hides the peripheral edge of the upholstery cover from view of a user when the rest of the tray is removed.

In some embodiments, a protective tray with an integrated dust cover has one or more flaps removably attached to the body portion along perforated seams facilitating raising the flaps to extend upwardly along the sofa sides forming a protective skirt. The flaps may be secured together by tape, adhesives, interlocking features, or mechanical fasteners.

According to an embodiment, a method of packaging an upholstered sofa for shipment and use includes providing a protective tray with an integrated dust cover having a body portion and one or more flaps attached to the body portion along a perforated seam; aligning the body portion of the protective tray with an integrated dust cover with a bottom edge of the upholstered furniture; securing the protective tray with an integrated dust cover to the bottom edge of the upholstered furniture; folding the one or more flaps of the protective tray with an integrated dust cover around the bottom edge of the upholstered furniture.

A feature and advantage of embodiments is a protective tray attached to the bottom of a sofa by staples to the sofa frame, the protective tray spanning a open bottom of the frame, the tray having a separation means allowing portions surrounding a central portion covering the open bottom to be separated from the central portion leaving the central portion with a clean peripheral edge.

A feature and advantage of embodiments of the disclosure is the elimination of a panel by combining the dust cover and shipping tray, resulting in cost savings. A feature and advantage of embodiments of the disclosure is the ability to automate the application of the dust cover to the furniture by replacing fabric with a semi-rigid material capable of being manipulated by assembly robots. Automation allows for lower overall expense, fewer injuries, a more consistent and uniform look across multiple pieces of furniture, and a general reduction in the number of fasteners used. A feature and advantage of embodiments of the disclosure is a reduction of waste material by limiting the waste to the removable flaps. A feature and advantage of embodiments of the disclosure is that the user can easily remove and discard the flaps, allowing a piece of furniture to remain protected during all stages of transport from the manufacturer to the user.

A feature and advantage of embodiments is that the dust cover, normally not rigid, can be supported by a peripheral bottom portion and skirt portion of the protective cover and integrated dust cover, and be robotically picked up and attached to the sofa. In embodiments, the dust cover may be flexible or non rigid such that without the supporting skirt portion it would not be able to be readily picked up by the vacuum graspers of industrial robots; but with the surrounding skirts, the combination can be picked up and robotically attached to a sofa frame.

Figure 1:
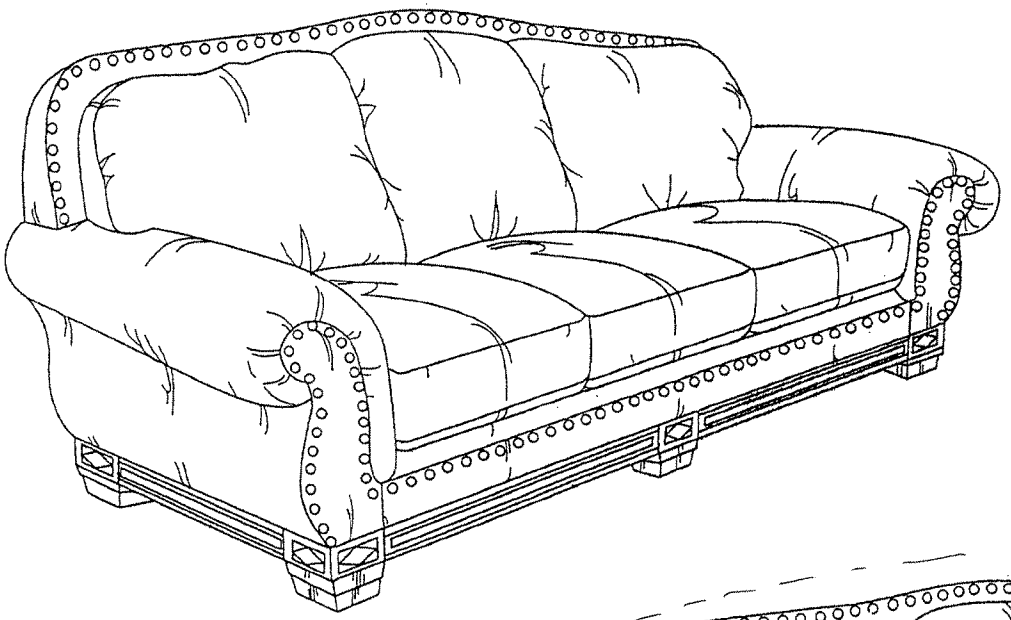
Prior Art Fig. 1
FIG. 1 is a perspective view of a prior art sofa.
Figure 2:
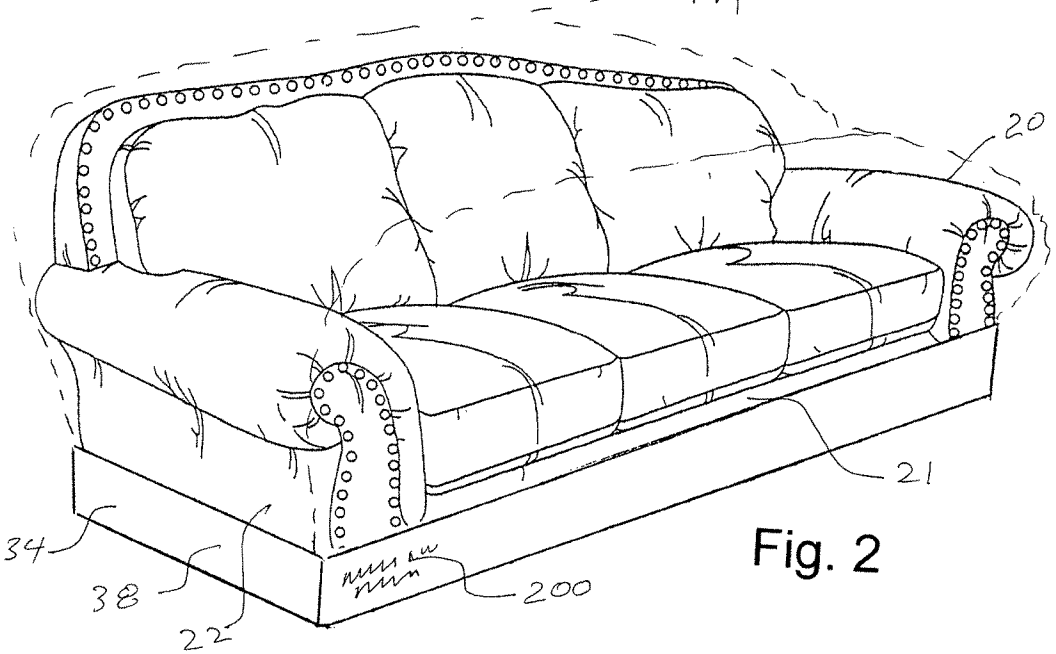
FIG. 2 is the sofa of FIG. 1 with a protective tray thereon in accord with embodiments.
Figure 3:
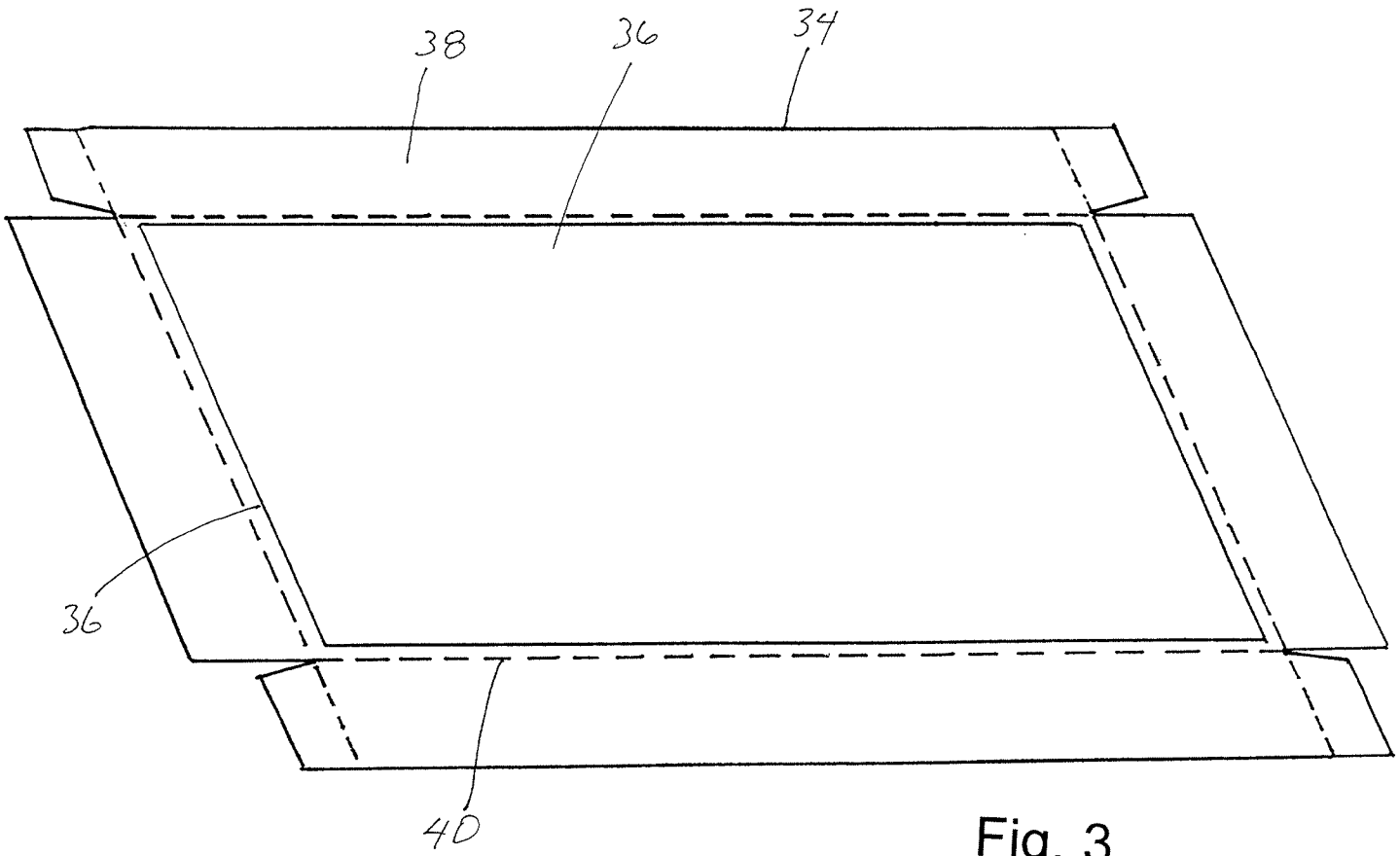
FIG. 3 is a protective tray with an integrated dust cover in accord with embodiments.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIGS. 2-7 and 9, a sofa 20 and a protective bottom tray with an integrated dust cover 34 is generally illustrated. Cardboard sofa trays are known for providing protection during transportation and storage before being displayed or shipped to customers. Such trays are typically applied onto fully manufactured sofas. They may be applied with or without sofa feet attached. The sofa having a front side 21, a pair of lateral sides 22, a backside 23, and a bottom side 24. A wood frame 25 includes a lowermost rectangular frame portion 26, having a downwardly facing frame surface 27, and defining a frame opening 28.

In embodiments, the sofa tray comprises a bottom portion 36 and a skirt portion 38. Fold lines 40 may separate the bottom portion and skirt portion. The fold lines may be pre-creased or indented lines defining the fold lines. The sofa having a wood frame 41, lower frame portion 41 with a downwardly facing frame surface 42.

In the form of FIGS. 3-7, the protective bottom tray is semi-rigid, capable of being grasped and lifted by robotic vacuum pickup arms, and is substantially planar, flat, or panelar, recognizing the flat tray may flex under its own weight. The skirt portion 38 in this form constitute flaps 45 that are not yet folded. The trays may be cardboard such as corrugated or solid fibrous cardboard. The bottom portion 36 has a bottom peripheral portion 46 that is unitary with the skirt portion. The peripheral portion joins a central dust cover portion 50 at a separable juncture 54, the dust cover portion 50 covering the frame opening 28 and spans most of the exposed bottom side of the sofa.

Figure 4:
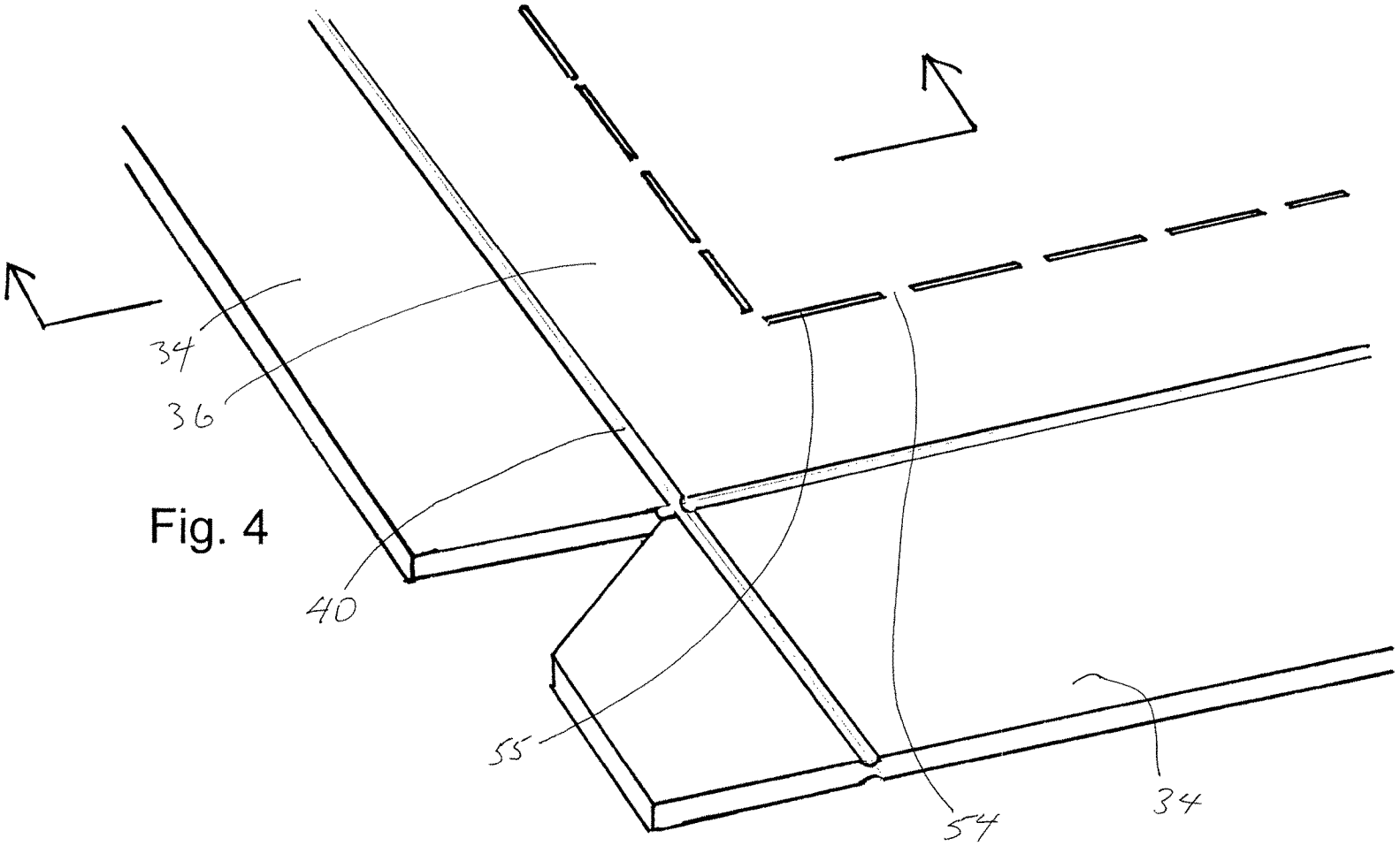
FIG. 4 is a perspective view of an enlarged corner of an integrated dust cover in accord with embodiments.
Figure 5:
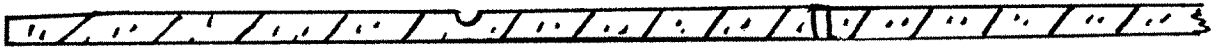
FIG. 5 is a cross section taken at line 5-5 of FIG. 4.
Figure 6:
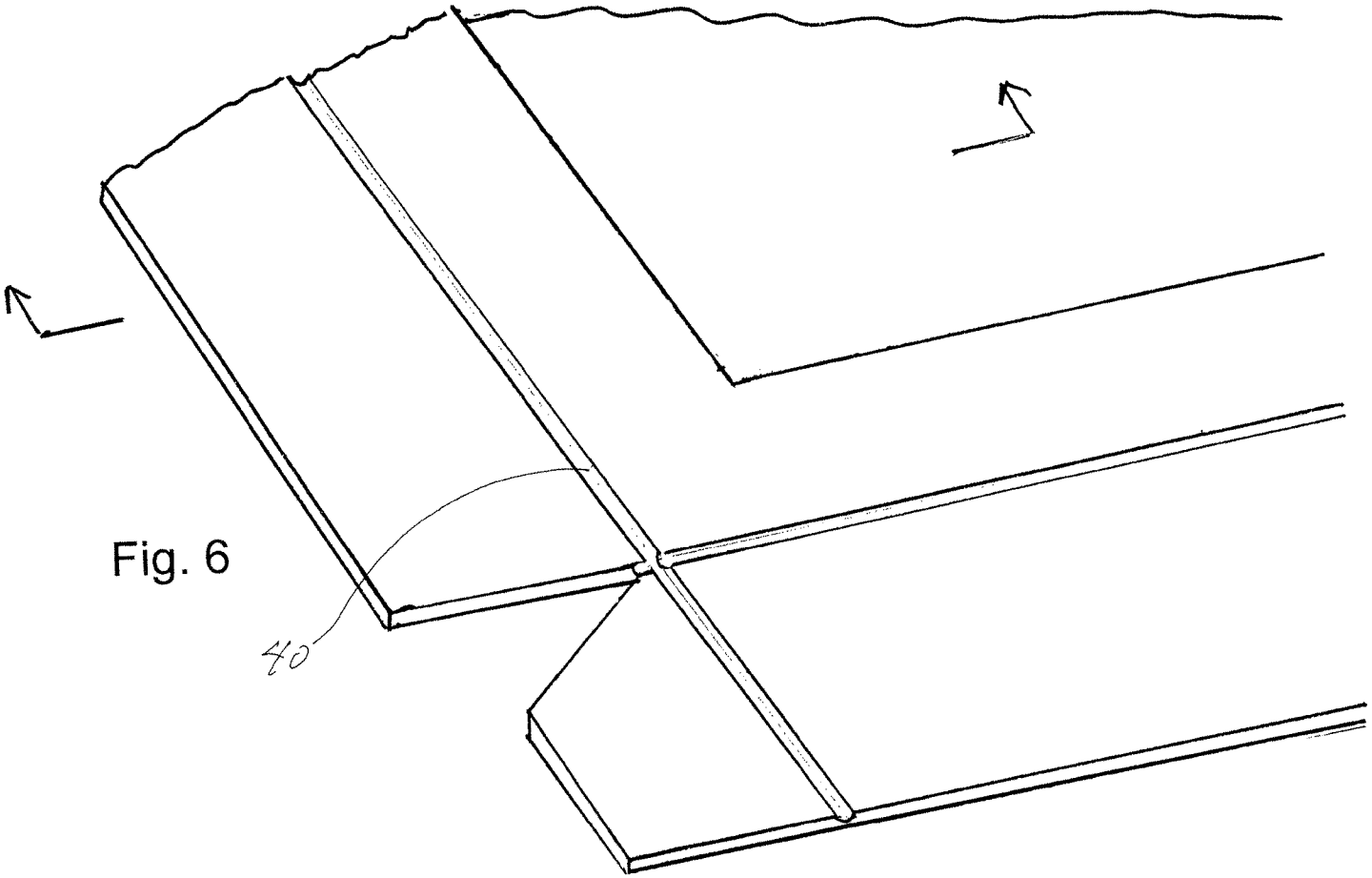
FIG. 6 is a perspective view of an enlarged corner of a protective tray with an integrated dust cover in accord with embodiments.
Figure 7:
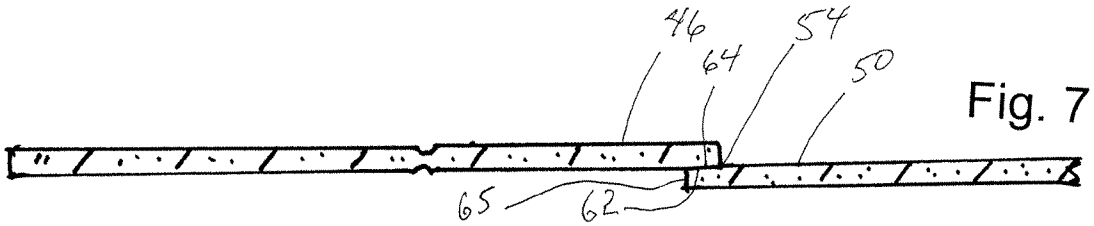
FIG. 7 a cross section taken at line 7-7 of FIG. 6.
Figure 8:
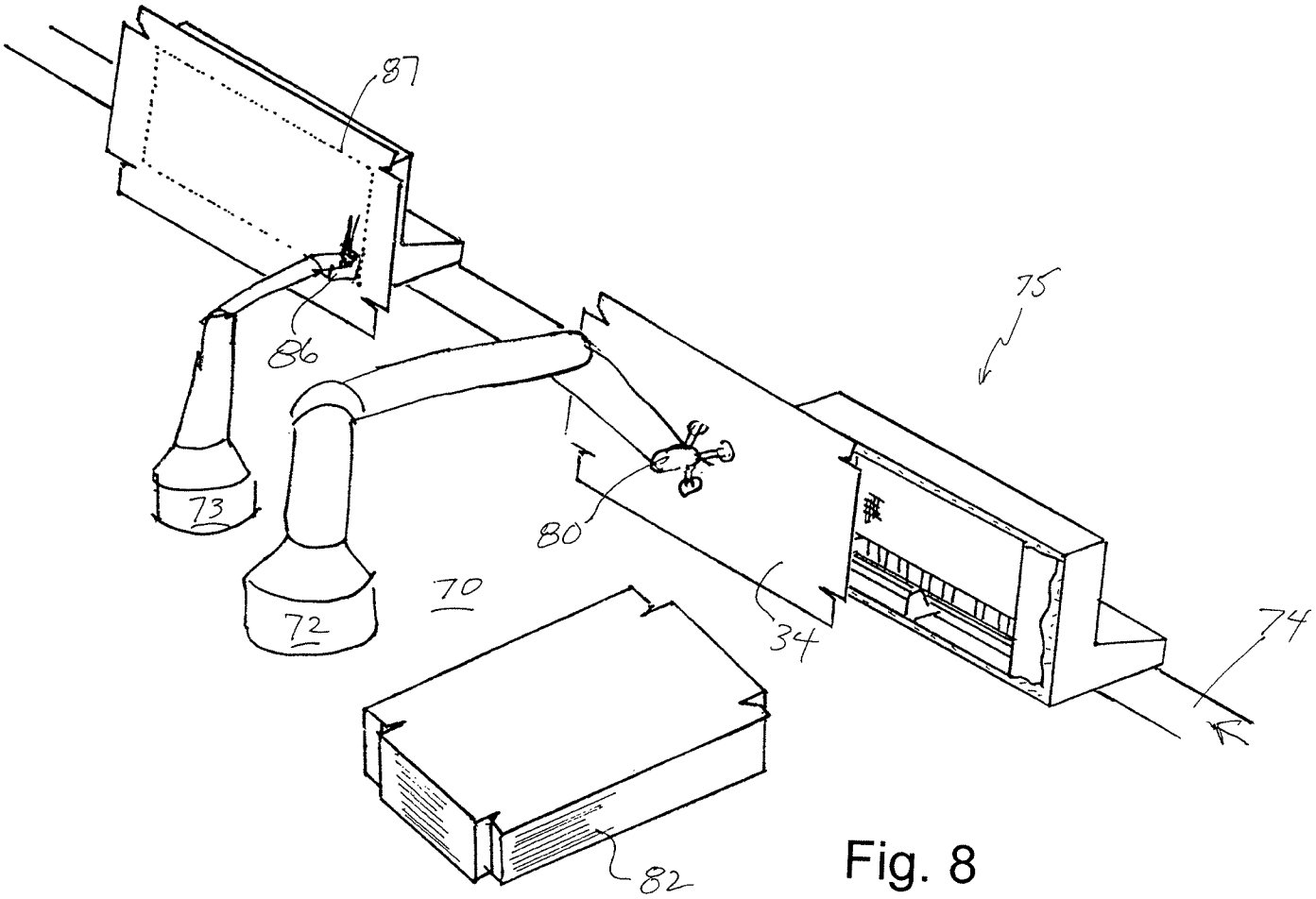
FIG. 8 is a perspective view of a portion of a manufacturing facility in accord with embodiments.
Figure 9:
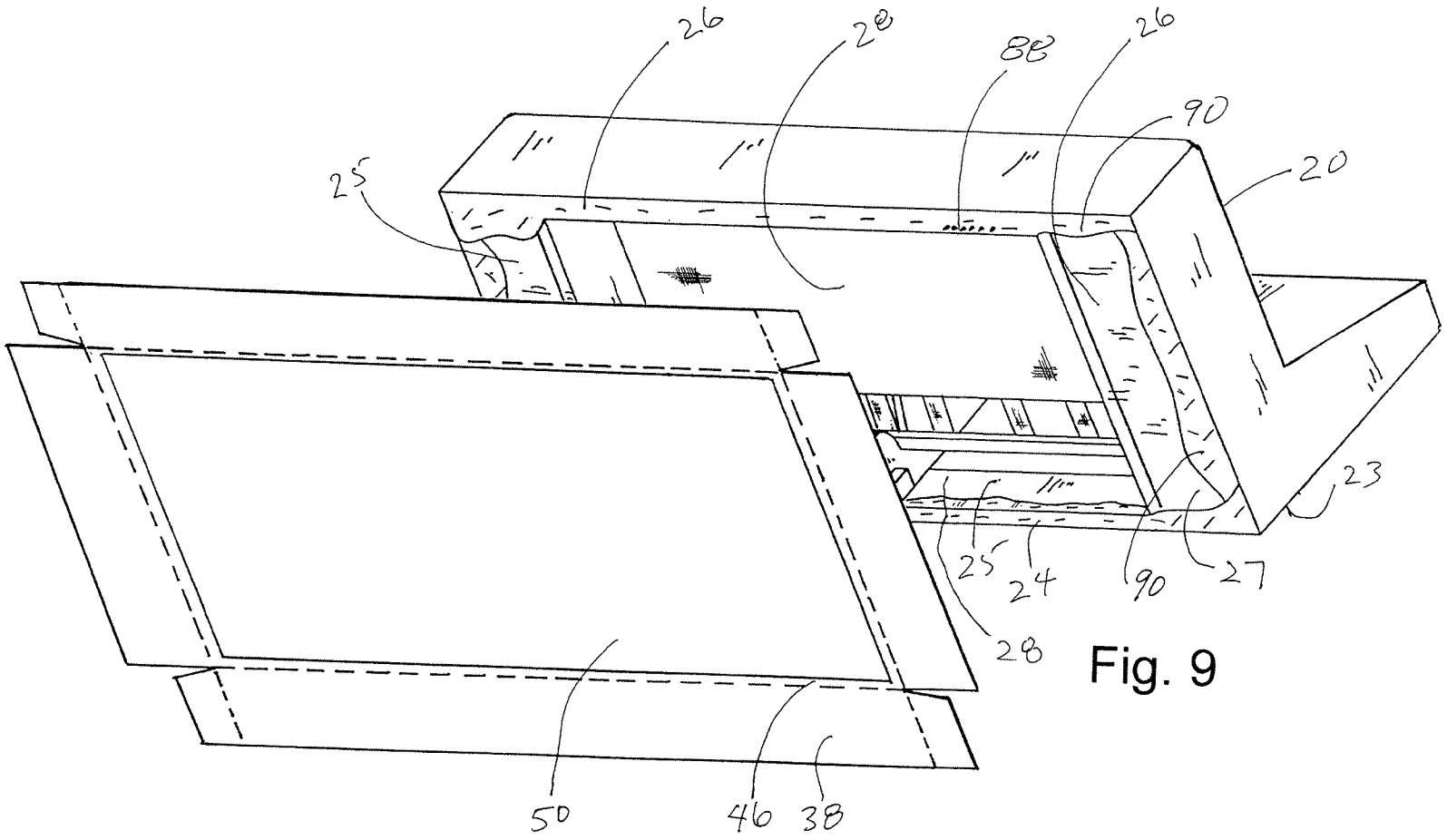
FIG. 9 is a perspective view of a sofa and a protective tray with an integrated dust cover.

As shown in FIG. 4, the separable juncture 54 may be defined by slits 55 or perforations. The peripheral portion and skirt portion may be separated at the juncture 54 in FIGS. 4 and 5 by tearing the material of the bottom portion as guided by the slits 55. Referring to FIGS. 6 and 7, the juncture 54 is formed by an adhesive interface 60 between respective faces 62, 64 of the bottom peripheral portion 46 and the dust cover portion 50. The adhesive interface is sufficient to hold the components together during attachment, transport, and handling but can be manually disrupted when desires. Separation of the bottom peripheral portion leaves a clean peripheral edge 65 of the dust cover portion.

Figure 10:
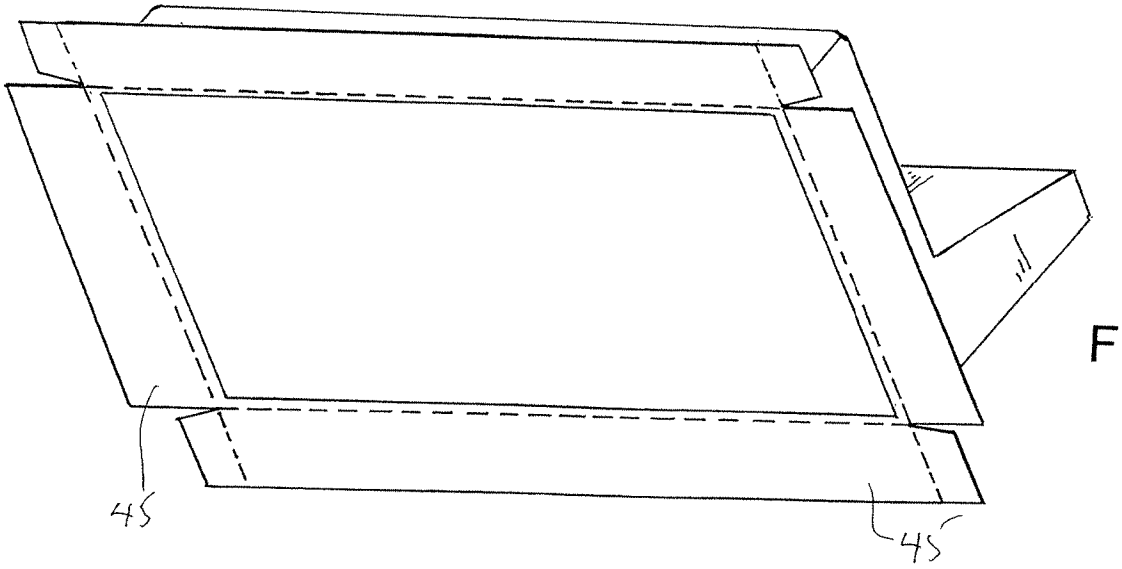
FIG. 10 is a perspective view of the sofa and protective tray with an integrated dust cover of FIG. 9 positioned for attachment on the sofa.
Figure 11:
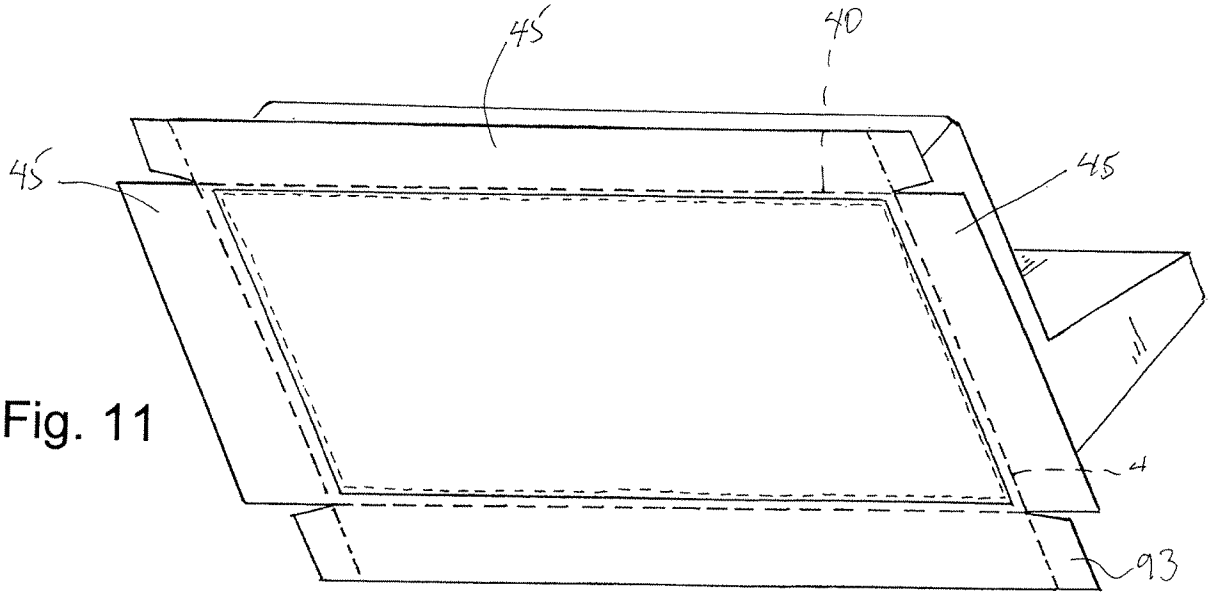
FIG. 11 is a perspective view of the sofa and protective tray with an integrated dust cover of FIGS. 9 and 10 attached to the sofa.
Figure 12:
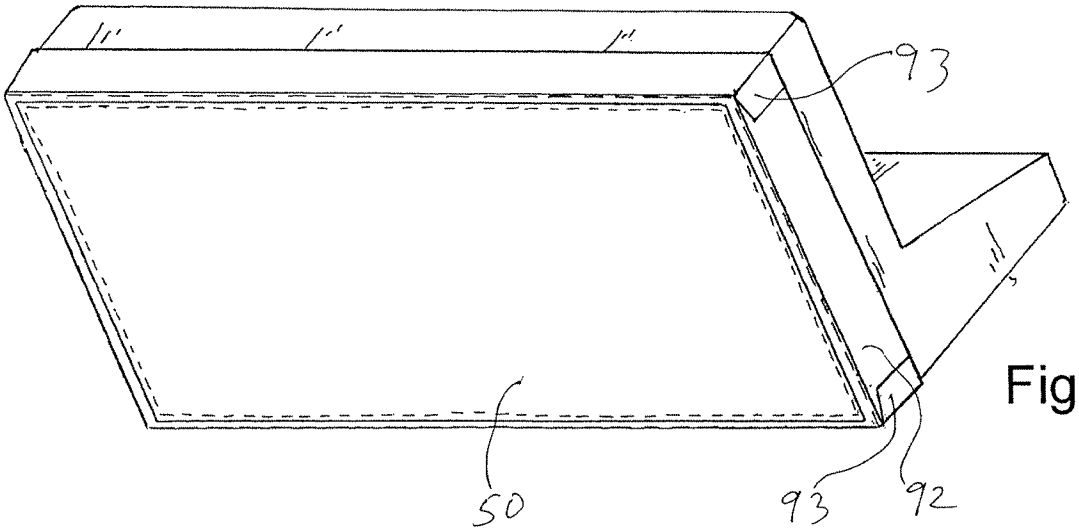
FIG. 12 is a perspective view of the sofa and protective tray with an integrated dust cover of FIGS. 9-11 with flaps defining a skirt portion folded to lay along the sides of the sofa and with the flaps adjoined together.
Figure 13:
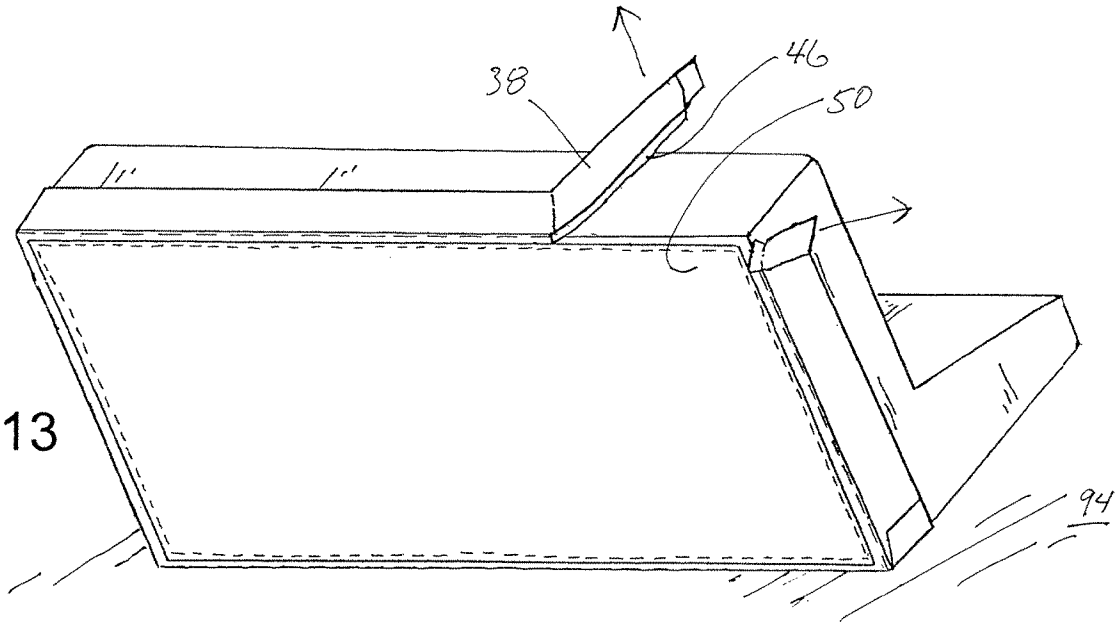
FIG. 13 is a perspective view of the sofa of FIG. 12 with the skirt portion and bottom peripheral portion being separated from a central dust cover.
Figure 14:
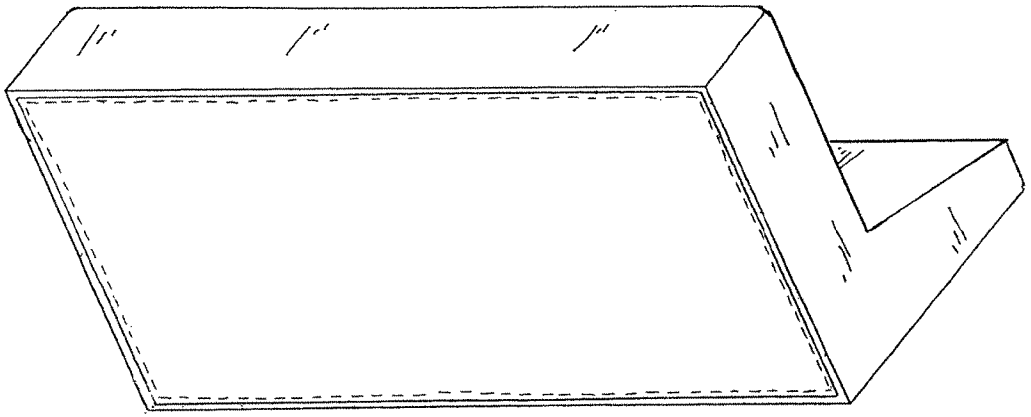
FIG. 14 is a perspective view of the sofa of FIG. 13 with the skirt portion and bottom peripheral portion removed and the central dust cover remaining attached to the sofa.
Figure 16:
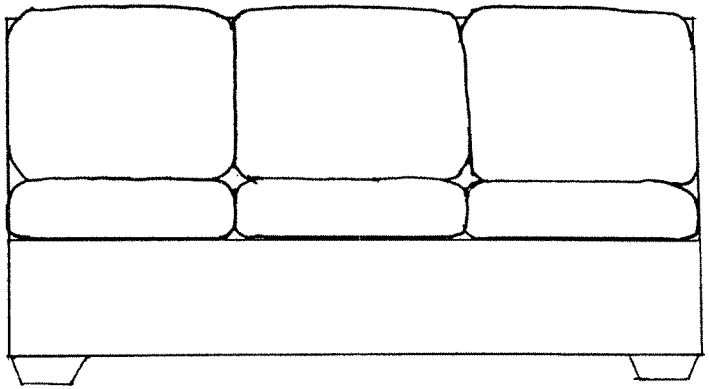
FIG. 16 is a front elevational view of the sofa of FIG. 15 with cushions in place ready for sale or use.
Figure 15:
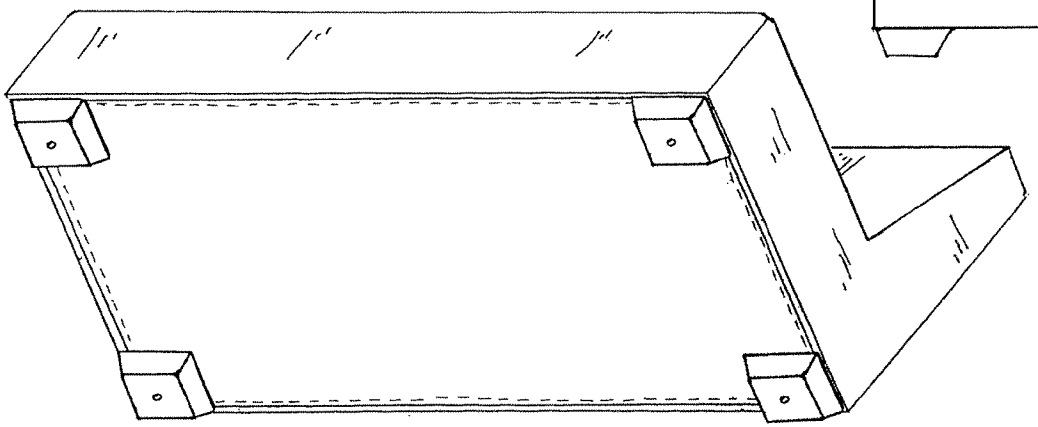
FIG. 15, is a perspective view of the sofa of FIG. 14 with feet attached.
Figure 17:
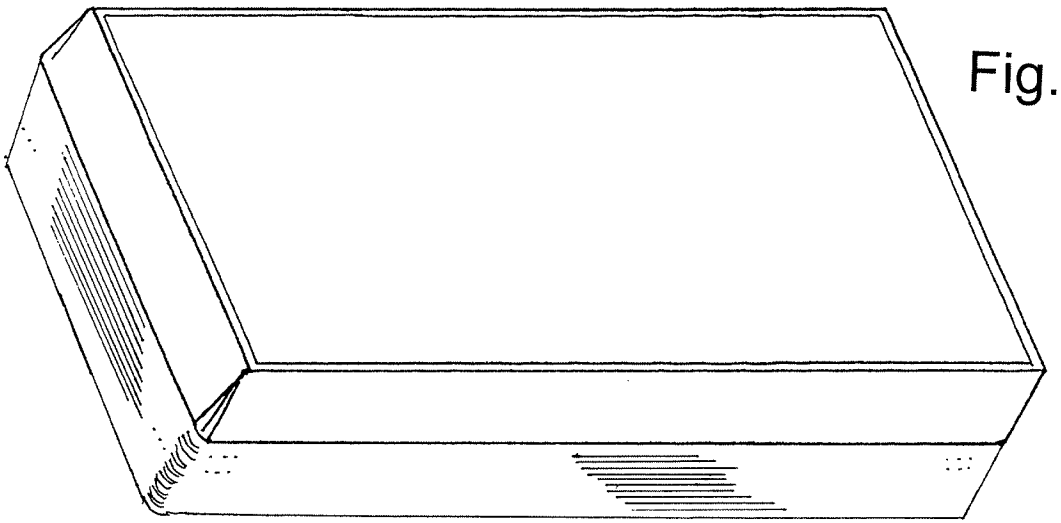
FIG. 17 is a stack of a different embodiment of protective trays with integrated dust covers.
Figure 18:
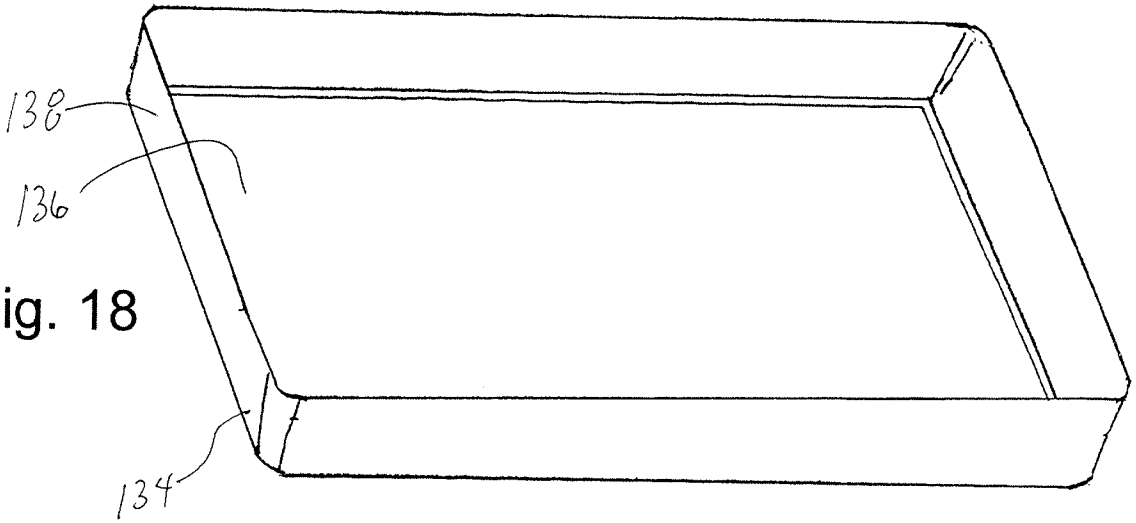
FIG. 18 is a top perspective view of one of the protective trays of FIG. 17.

Referring to FIGS. 8-16, steps and components associated with the attachment of a protective tray with an integrated dust cover 34 at a manufacturing facility 70 is illustrated. The facility has industrial robots 72, 73, and a conveyor 74. The conveyor is part of an assembly line 75 where sofas are sequentially manufactured. Upstream of the portrayed line portion, the upholstery coverings 76 are attached to wooden frames 77. One robot 72 has an arm with vacuum grasper 80 to grasp individual ones of a stack 82 of the protective covers. The sofas travel on the conveyor and the robot positions a protective cover on a sofa, as shown in FIG. 10. The second robot 73 with a stapler 86 that staples with staples 87, the protective cover to the frame of the sofa while the first robot, at least initially, holds the protective cover in proper position, as shown in FIG. 11. In embodiments, both tasks may be done by the same robot or one or the other task may be done manually with production line workers. The staples are inserted along a bottom edge portion 88, see dots in FIG. 9, such that the dust cover portion 50 will substantially cover the attached upholstery edge portions 90. See FIG. 11. The flaps 45 of FIG. 11 may then be folded along fold lines 40 to provide the upwardly (with respect to an upright sofa) extending skirt 92. The flaps may be held in place by suitable adhesives, for example on tabs 93, by tape, by interlocking features, or by fasteners, such as staples, or other means, not shown. FIG. 13 illustrates the skirt portion 38 and attached bottom peripheral portion 46 being removed, such as be tearing, from the dust cover portion 50 attached to the wood frame. Such may be performed at a retail sales facility 94.

Referring to FIGS. 17-26, another embodiment of the protective tray and integrated dust cover is illustrated. In this embodiment, the protective tray 134 is preformed to be tray shaped and has a bottom portion 136 and a skirt portion 138. The preformed tray may be formed of polymeric material, such as heat forming thin sheets of plastic, or formed of fibrous material including cardboard. The skirt portion 138 may have an outward taper to provide easy positioning on the bottom side 124 of the sofa 120. The taper may be minimized after application such as by tightening the corners 139 such as by taping strips of tape across the corners. In this regard the corners may have slits, folds, or corrugations 141.

Figures 19, 20:
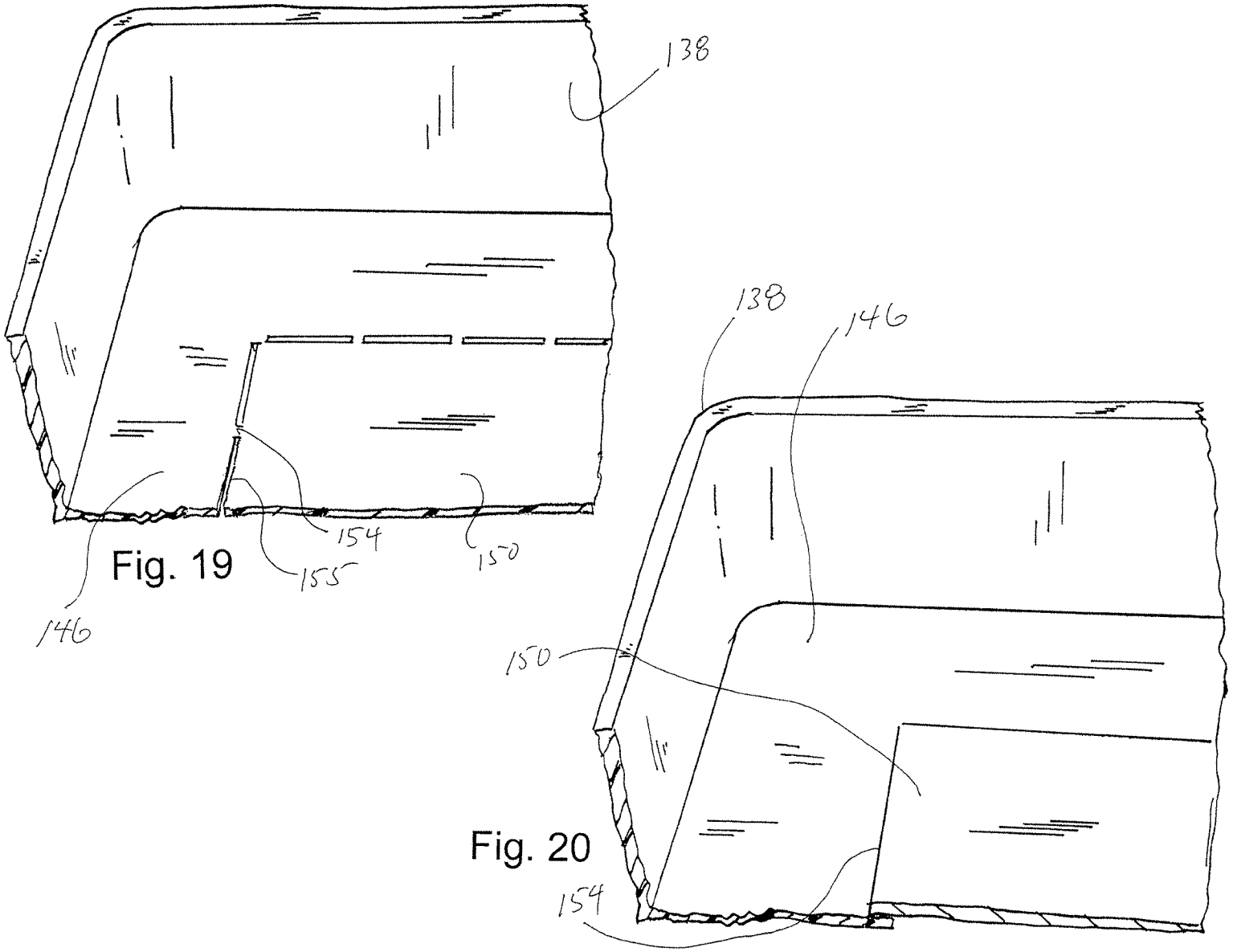
FIG. 19 is an enlarged perspective view of a portion of an embodiment of a tray as portrayed in FIG. 18.
FIG. 20 is an enlarged perspective view of a portion of an embodiment of a tray as portrayed in FIG. 18.
Figure 21:
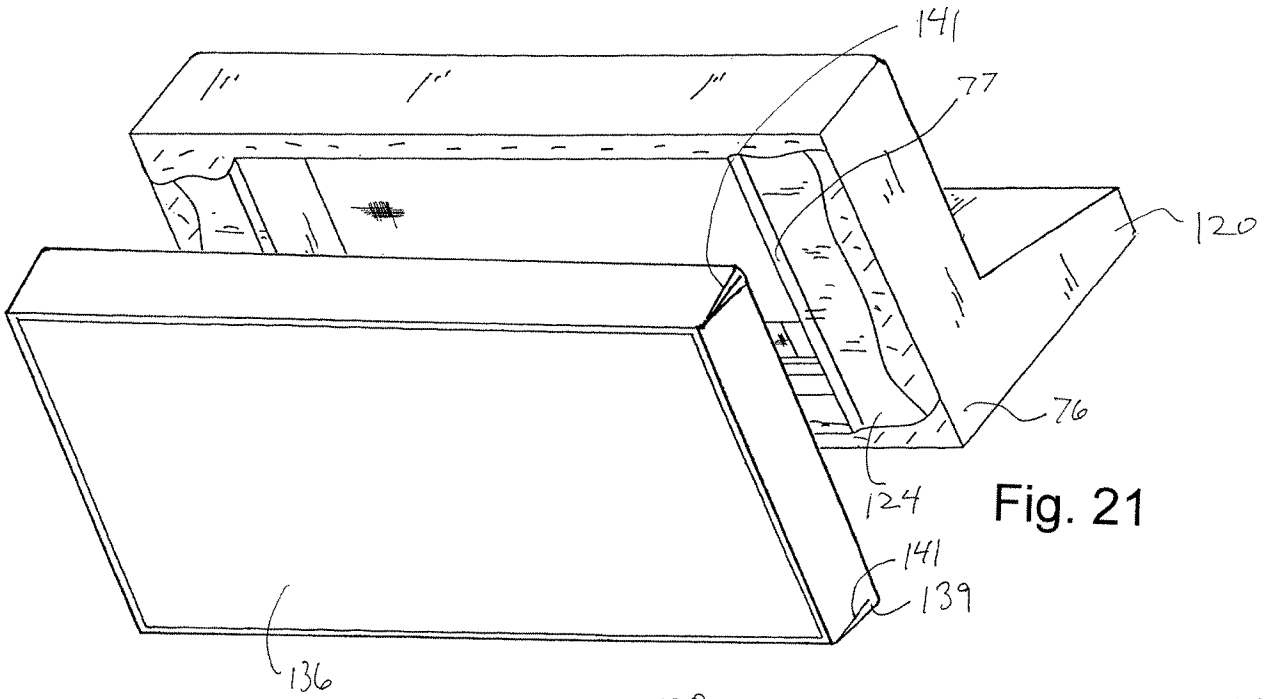
FIG. 21 is a perspective view of a sofa and the protective tray with an integrated dust cover of FIG. 18.
Figure 22:
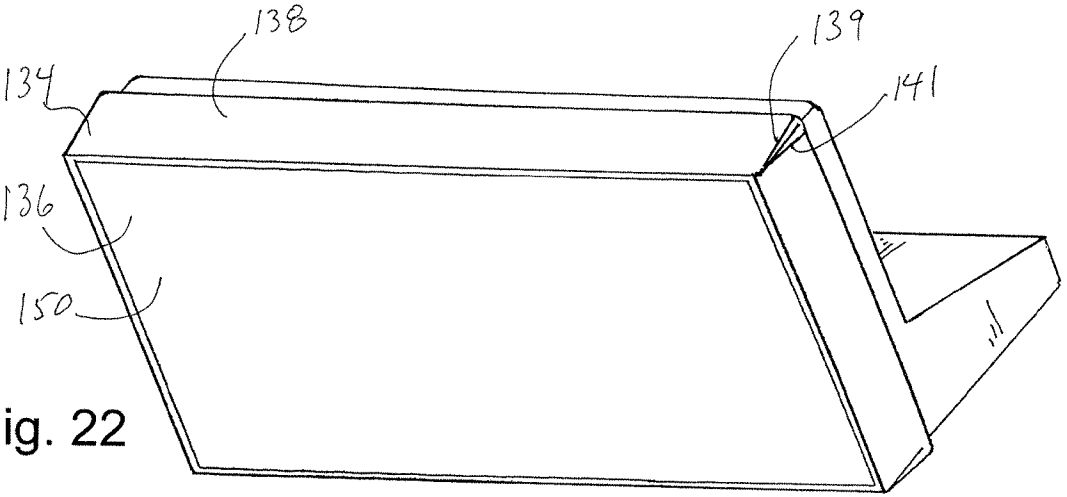
FIG. 22 is a perspective view of the sofa of FIG. 21 with the protective tray positioned on the sofa.
Figure 23:
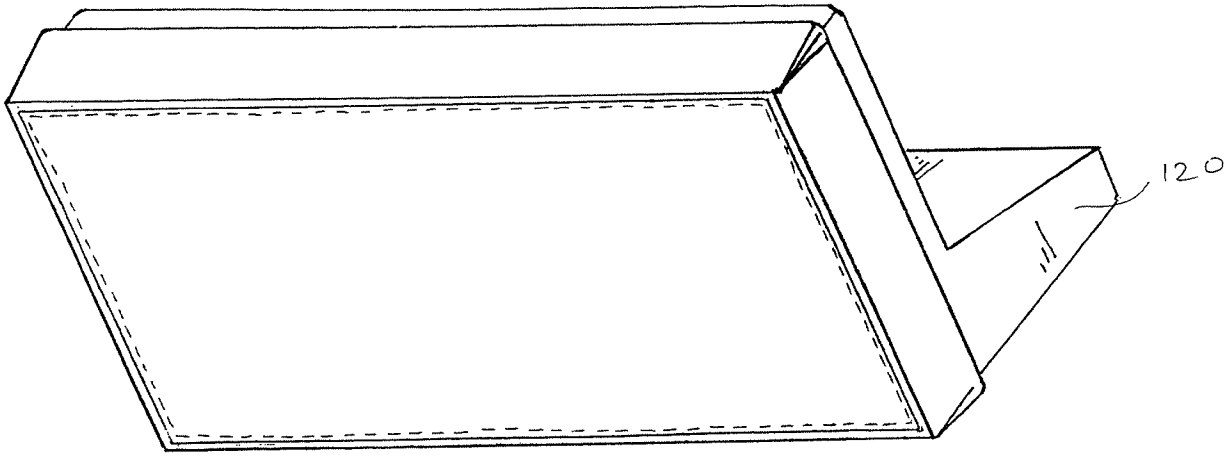
FIG. 23 is a perspective view of the sofa of FIG. 22 with the protective tray attached to the sofa.
Figure 24:
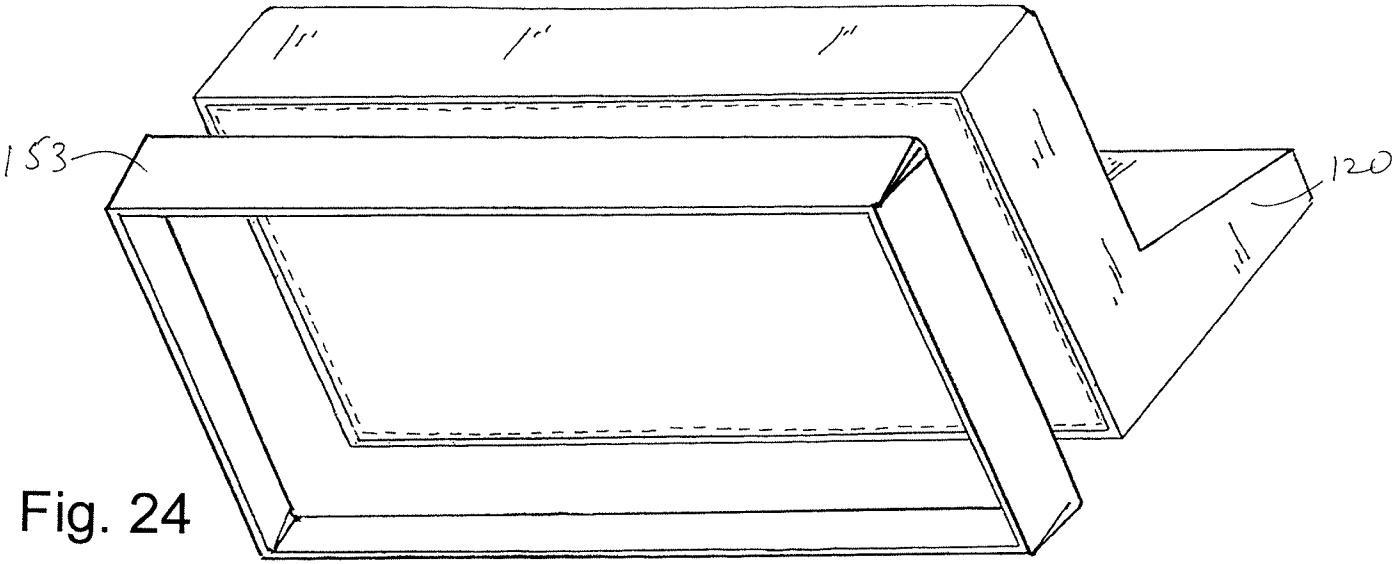
FIG. 24 is a perspective view of the sofa of FIG. 23 showing an exemplary separation of the skirt portion and bottom peripheral portion and the central dust cover portion.
Figure 25:
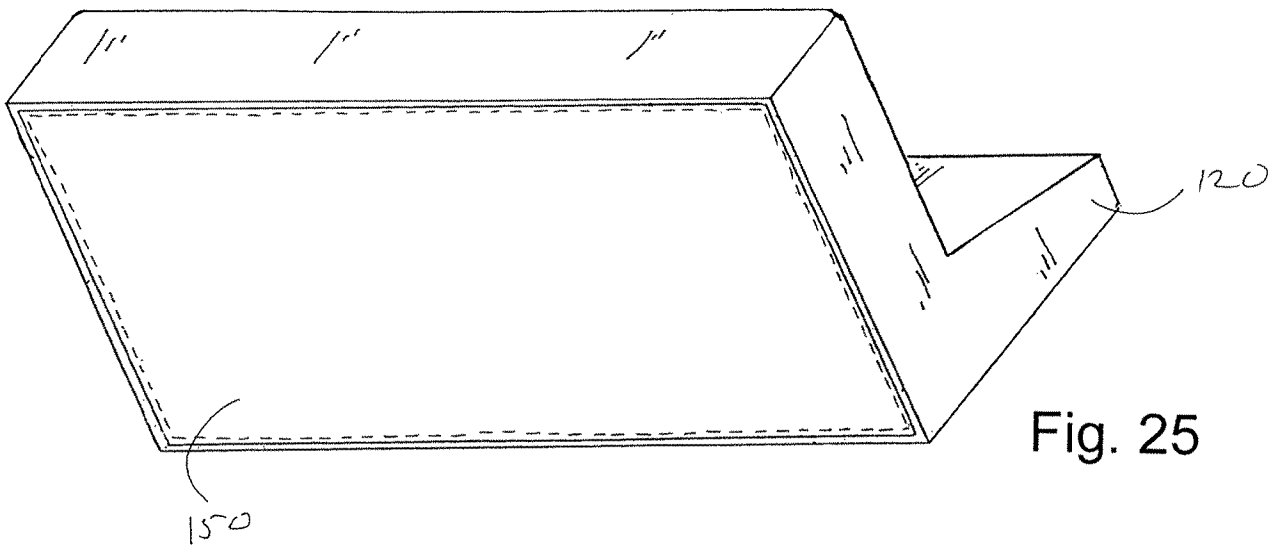
FIG. 25 is a perspective view of the sofa of FIGS. 21-24 with the dust cover on the sofa.
Figure 26:
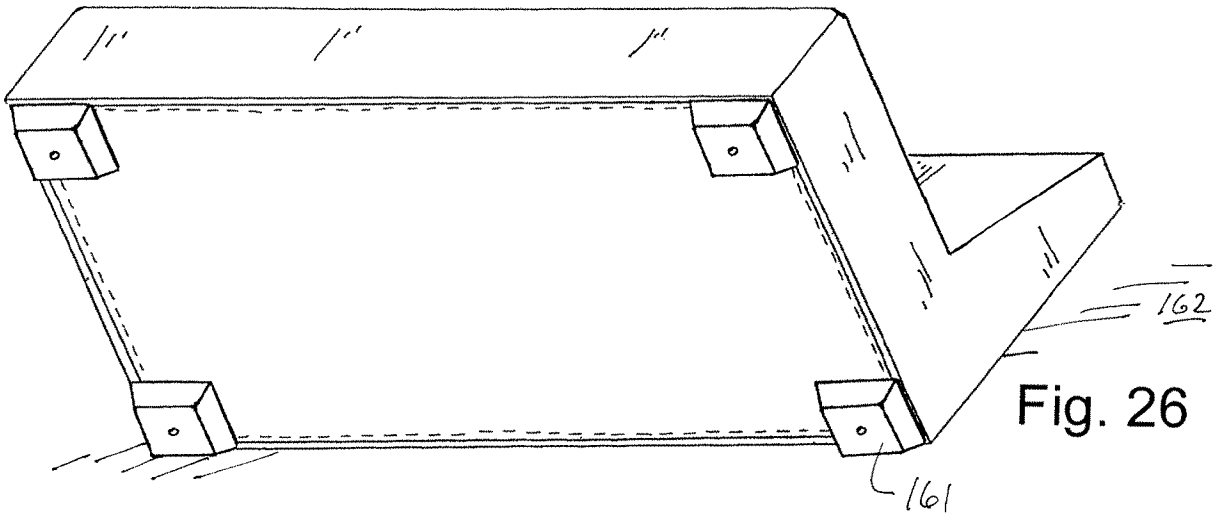
FIG. 26 is a perspective view of the sofa of FIG. 25 with the feet attached.

The protective tray and integrated dust cover 135 has perforations or slits or other separation facilitating features 155 as shown in FIG. 19, defining a separation juncture 154. In FIG. 20, the separation juncture 154 is the adhesive interface as described above. Another embodiment utilizes an embedded pull string or tape, which substantially or completely causes a separation. In another embodiment, a removable exterior tape bridges the dust cover portion and the rest of the tray. The materials of the dust cover portion and the skirt portion and bottom peripheral portion 146 may not be the same in the embodiment. For example the skirt portion and unitary bottom peripheral portion may be formed of a polymer sheet material and the dust cover portion 150 formed of cardboard, or vice versa. The dust cover may be colored black, with is common with existing sofa dust covers. Similarly, a fabric material may be layered on the cardboard or other dust cover portion substrate, by adhesive, to provide a more secure permanent sofa dust cover. Where the skirt portion and bottom peripheral portion are formed of a polymer sheet, separation may be by removal of the intact skirt and bottom peripheral portions as shown in FIG. 24, leaving the sofa with only the dust cover portion 150 as shown in FIG. 25. The feet 161 may than be attached, see FIG. 26, leaving only the cushions to complete the sofa assembly, such may typically be accomplished at the retailer facility or the user's home 162. The attachment of the protective tray and integrated dust cover will typically be at the manufacturer's facility where additional packaging such as boxes or plastic wrap, illustrated by dashed lines 199 on FIG. 2, may also be applied. The skirt portion may then be removed when delivered to a purchaser's home or at the retail show room and will typically be discarded. Instructions 200, see FIG. 2, may be provided with the sofa and tray, for direction proper or easy removal of the tray portions except the dust cover. In embodiments the dust cover may be integrated with a box for the sofa as well, where instead of tray skirt portions, the box with integrated dust cover would have box sides. The box would have separation means for the dust cover portion such as described above: perforations, slits, pull string, bridging tape, adhesive connections. The "dust cover" herein may also be termed a cover or a panel.

U.S. Pat. Nos. 3,043,490; 6,409,267; 9,380,877; 8,438,716; 10,512,338; 2019/0254440; and 2019/0290017 are incorporated by reference for all purposes.

The above references in all sections of this application are herein incorporated by references in their entirety for all purposes. All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A sofa with a protective bottom tray attached thereto, the sofa having a front side, two lateral sides, a back side, a bottom side, and a lower periphery with a peripheral edge portion, the sofa comprising a wood frame with upholstery thereon, the frame having a lowermost rectangular frame portion defining a bottom frame opening, the lowermost rectangular frame portion having a downwardly facing frame surface, upholstery edge portions being secured at the downwardly facing frame surface;

the protective bottom tray having a bottom portion spanning the bottom side and an upward skirt portion extending around and covering a portion of the front side, the lateral sides, and the rear side, the bottom portion having an integrated central dust cover portion that has a separable juncture with a bottom peripheral portion, the central dust cover sized to cover the bottom frame opening and to have a frame attachment edge portion, the frame attachment edge portion of the dust cover portion attached onto the downwardly facing frame surface with fasteners whereby the upward skirt portion and the bottom peripheral portion may be removed from the sofa while leaving the central dust cover attached, wherein the bottom portion has a series of slits or perforations defining the separable juncture.

2. The sofa with a protective bottom tray attached thereto of claim 1, wherein the bottom peripheral portion and the skirt portion do not having fasteners extending there through into the sofa frame.

3. The sofa with a protective bottom tray of claim 1 wherein the skirt portion and the bottom portion are formed of cardboard.

4. The sofa with a protective bottom tray of claim 1 wherein the skirt portion and bottom portion are formed of a polymer.

5. The sofa with a protective bottom tray of claim 1 wherein the skirt portion and bottom portion are formed of a fibrous material.

6. The sofa with a protective bottom tray of claim 1 wherein the skirt portion and bottom peripheral portion are formed of a first material and the dust cover portion is formed of a second material.

7. The sofa with a protective bottom tray of claim 1, wherein the separable juncture is defined by an adhesive interface.

8. The sofa frame of claim 1, wherein the skirt has a front side skirt portion, two lateral side skirt portions, and a backside skirt portion, and wherein the front side skirt portion is joined to each of the two lateral side skirt portions, and the backside skirt portion is also joined to each of the two lateral side skirt portions.

9. The sofa of claim 8, wherein the front side skirt portion is joined to portion is also joined to each of the two lateral side skirt portions by one of staples or adhesives.

10. A protective bottom tray for a sofa, the bottom tray having a bottom portion for spanning the bottom side and an upward skirt portion for extending around a front side, lateral sides, and a rear side of the sofa, the bottom portion having a bottom peripheral portion and an integrated central dust cover portion surrounded by the bottom peripheral portion, a separable juncture having a rectangular shape between the bottom peripheral portion and the integrated central dust cover portion, wherein a series of slits or perforations define the separable juncture.

11. The protective bottom tray of claim 10 wherein the integrated dust cover is adhesively attached to the bottom peripheral portion at the separable juncture.

* * * * *